United States Patent [19]

Watanabe

[11] Patent Number: 4,462,112

[45] Date of Patent: Jul. 24, 1984

[54] SPEAKER SYSTEM

[75] Inventor: Tathuya Watanabe, Tokyo, Japan

[73] Assignee: Clarion Co., Ltd., Tokyo, Japan

[21] Appl. No.: 452,236

[22] Filed: Dec. 22, 1982

[30] Foreign Application Priority Data

Dec. 25, 1981 [JP] Japan ..... 56-193843[U]

[51] Int. Cl.[3] ..... H04R 3/12

[52] U.S. Cl. ..... 381/109; 381/24; 381/90; 179/115.5 PS

[58] Field of Search ..... 181/144; 381/109, 24, 381/90, 89, 86; 179/146 E, 115.5 PS

[56] References Cited

U.S. PATENT DOCUMENTS 3,275,758 9/1966 Bryan et al. ..... 179/115.5 PS

*Primary Examiner*—G. Z. Rubinson
*Assistant Examiner*—James L. Dwyer
*Attorney, Agent, or Firm*—Flynn, Thiel, Boutell & Tanis

[57] ABSTRACT

A speaker system which comprises two speakers and a switch for selectively connecting one of the speakers to an input through a volume controller. The other of the speakers is always connected to the input, so that in response to switching action of the switch, two speakers may operate as twin-drive woofers or the former one of the speakers may operate as a passive radiator. The volume controller is used for attenuation adjustment of the twin-drive woofers and damping adjustment of the passive radiator.

3 Claims, 9 Drawing Figures

SPEAKER SYSTEM

BACKGROUND OF THE INVENTION

1. Field of the Invention

This invention is directed to an improvement of a speaker system, and more particularly to a speaker system which can be operative both as a twin-drive speaker system wherein two woofers are simultaneously driven and as a passive radiator.

2. Description of the Prior Art

There have conventionally been known the following compact speaker systems.

Figure 1:
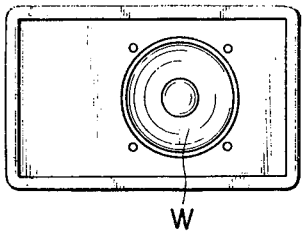
FIG. 1 PRIOR ART
FIG. 1 shows a closed-type speaker system in which an enclosure containing a woofer W therein is completely closed from the outer air. Since the internal volume of the enclosure is small, the enclosure is configured in an acoustic suspension or in an air suspension.

In the closed construction of FIG. 1, sound reproduction cannot be effected in low-range when the speaker system is a compact one with a small volume and a small diameter.

Figure 2:
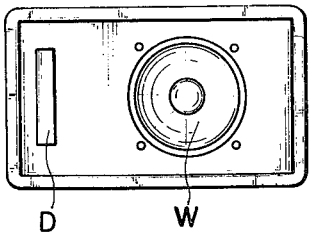
FIG. 2 PRIOR ART
FIG. 2 shows a bass-reflex speaker system in which a duct D is provided in the enclosure to utilize resonance of the duct D to improve reproduction of low-range sound.
Figure 3:
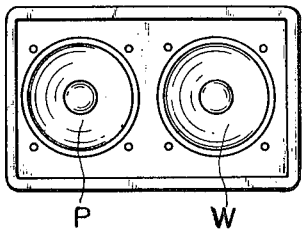
FIG. 3 PRIOR ART
FIG. 3 shows a passive radiator type speaker system in which a passive radiator P is driven by back pressure of a woofer to thereby increase low-range sound.
Figure 4:
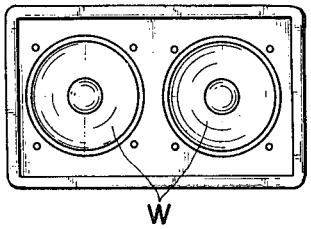
FIG. 4 PRIOR ART
Figure 5:
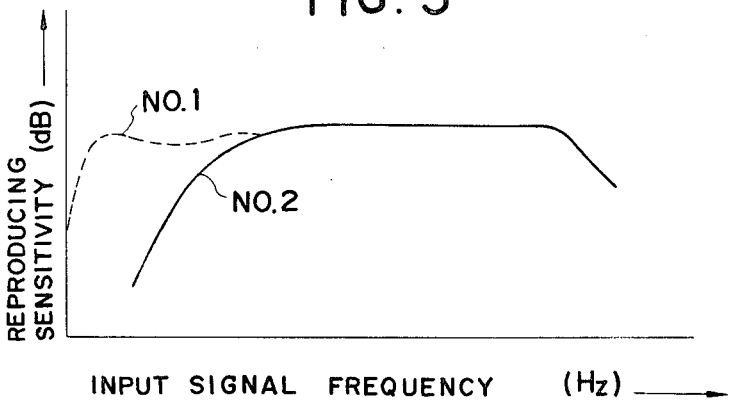

In this connection, the bass-reflex speaker system of FIG. 2, the passive radiator type speaker system of FIG. 3 or a system as shown in FIG. 4 which is of a closed type and includes two woofers are used. However if those constructions are used in speaker systems for cars, sound characteristic in low range varies depending on the shapes of cars and positions in a car room for mounting the speaker systems. For example, characteristic No. 2 obtained when the speaker system is positioned in a room without resonance and characteristic No. 1 obtained when the speaker system is mounted in a car room are different from each other as shown in FIG. 5. Although differences of the characteristic extremely vary depending on shapes of car bodies, it has been quite difficult, in the conventional speaker systems, to adjust the low-range sound characteristic for every car.

OBJECT OF THE INVENTION

It is therefore an object of the present invention to alleviate the aforementioned drawbacks involved in the prior art, by providing a novel speaker system which includes two speakers one of which is always connected to an input and the other of which is selectively connected to the input through a volume controller by use of a switch so that in response to switching action of the switch, said two speakers may operate as twin-drive woofers or the other speaker may operate as a passive radiator. At the same time, attenuation adjustment of the twin-drive woofers or damping adjustment of the passive radiator is effected by the volume controller.

SUMMARY OF THE INVENTION

In accordance with the present invention, there is provided a speaker system which comprises:

an enclosure;

two speakers contained in said enclosure;

a switching means for applying input signals to one or both of said speakers; and a volume controller connected between said one of the speakers and said switching means.

BRIEF DESCRIPTION OF THE INVENTION

Figure 7:
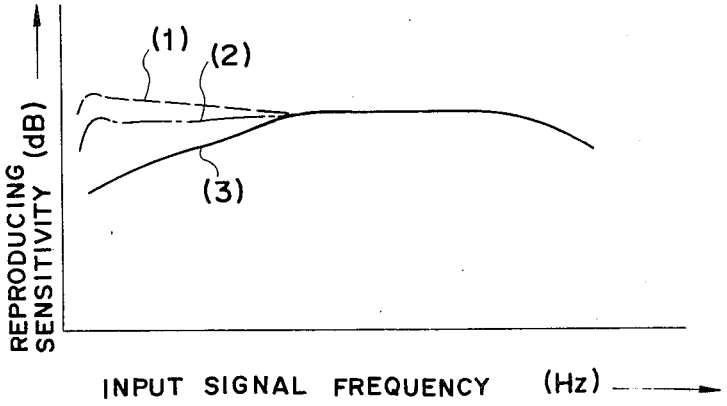
Figure 8:
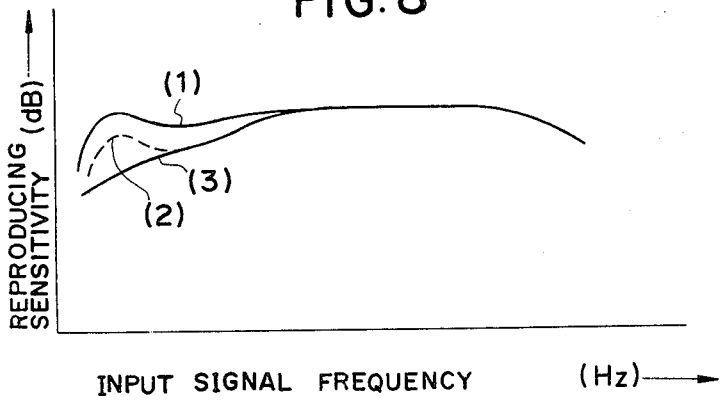
Figure 6A:
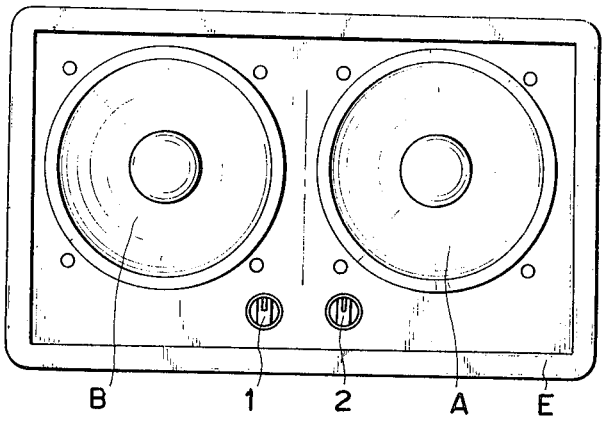
Figure 6B:
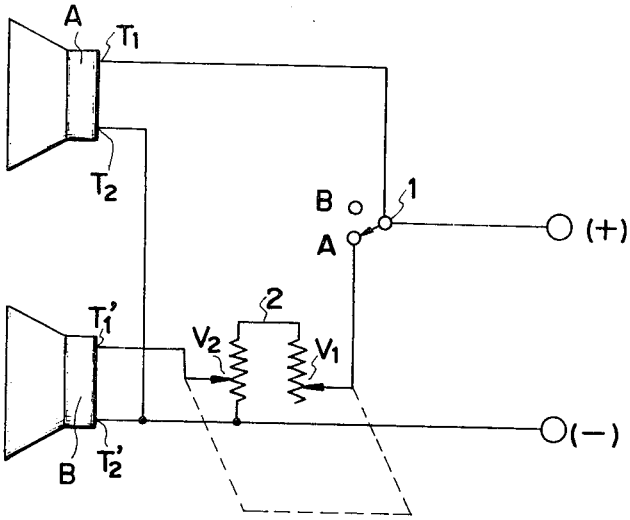

FIGS. 1 to 4 are front elevations illustrating conventional speaker systems, respectively;

FIG. 5 is a graph showing reproduction sensitivities and input signal frequencies of a conventional speaker system;

FIG. 6A is a front elevation showing an embodiment of the speaker system according to the present invention;

FIG. 6B is a circuit diagram of the same embodiment; and,

FIGS. 7 and 8 are graphs showing relations between reproduction sensitivities and input signal frequencies of the same embodiment.

DETAILED DESCRIPTION OF THE PREFERRED EMBODIMENT

The present invention will now be described in detail by way of a preferred embodiment referring to the drawings.

As shown in FIG. 6A, the speaker system comprises two woofers A and B both contained in an enclosure E, a switch 1 and a volume controller 2. An input terminal [+] is connected to first terminal $T_1$ of the woofer A as shown in FIG. 6B. Second terminal $T_2$ of the woofer A as well as second terminal $T'_2$ of the woofer B is connected another input terminal [−]. The input terminal [+] is connected to one of movable terminals $V_1$ of the volume controller 2 through the switch 1 while first terminal $T'_1$ of the woofer B is connected to the outer movable terminal $V_2$ of the volume controller 2.

In FIG. 6B, when the switch 1 is positioned in A, input signal is applied to the woofers A and B, so that the speaker system operates as a twin-drive woofer system. At that time, input signal level (attenuation) can be adjusted by the volume controller 2.

FIG. 7 shows characteristics of reproduction sensitivities (dB) and input signal frequencies (Hz) when the speaker system is in the above-mentioned state. In this graph, the line (1) corresponds to maximum volume, the line (2) to minimum volume, and the line (3) to intermediate volume between (1) and (2), respectively. In this case, the volume controller 2 operates as an attenuator of the woofer B, whereby the woofer B reproduces sound up to an intermediate level.

Next, when the switch 1 is positioned in B, the woofer B is not applied with input signal and it is driven only by back pressure of the woofer A. Therefore, the woofer B operates as a passive radiator. At that time, since reverse electromotive current which generates within a voice coil (not shown) flows to the volume controller 2, it is possible to apply electromagnetic damping to the woofer B by adjusting the volume controller 2. The damping force may be controlled by the volume controller 2.

FIG. 8 shows reproduction characteristics of reproduction sensitivities (dB) and reproduction frequencies (Hz). The line (1) corresponds to the maximum volume, the line (2) to the minimum volume, and the line (3) to an intermediate volume between (1) and (2), respectively. The volume cntroller 2 operates as a damping adjuster of the woofer which then functions as a passive radiator to thereby obtain a characteristic with sound pressure level rising near the resonance frequency of the woofer B.

As described in the above, the speaker system according to the present invention enables to vary frequency response in low range. Therefore, the speaker system may meet with various environments of car rooms, various musics or various tone qualities of amplifiers of tape decks. Further, since a normal speaker unit is used as a passive radiator and damping of the passive radiator is adjusted by use of a resistor connected to a voice coil terminal of the speaker, parts for twin-drive woofers may be used. This leads to cost reduction for manufacturing speaker systems.

I claim:

1. A loudspeaker system comprising: a speaker box having first and second apertures in the wall means thereof; first and second loudspeakers mounted in said first and second apertures, respectively, so that the diaphragm of each of said loudspeakers faces outwardly of said speaker box through its associated aperture, said loudspeakers each having first and second voice coil terminals; first and second system input terminals provided on said box and adapted to be connected to an audio signal source; a switch having a switch input terminal connected to said first system input terminal, said switch having a switch output terminal and means for selectively connecting said switch input terminal to said switch output terminal and disconnecting it therefrom; a volume controller connected to said switch output terminal and said first and second voice coil terminal of said second loudspeaker; said first voice coil terminal of said first loudspeaker being directly connected to said first system input terminal, said second voice coil terminals of said first and second loudspeakers being connected together and to said second system input terminal.

2. A loudspeaker system according to claim 1 in which said volume controller comprises adjustable electrical resistance means having two movable terminals, one of said movable terminals of said volume controller being connected to said switch output terminal and the other of said movable terminals being connected to said first voice coil terminal of said second loudspeaker.

3. A loudspeaker system according to claim 1 in which said speaker box has a front wall and said first and second apertures are provided in said front wall in side-by-side relation, said first and second loudspeakers being woofers which are mounted in said first and second apertures, respectively.

* * * * *